US005515876A

United States Patent [19]

Warner et al.

[11] Patent Number: 5,515,876

[45] Date of Patent: May 14, 1996

[54] TORSION BAR ASSEMBLY

[75] Inventors: Charles E. Warner, Troy; Ronald D. Schaefer, West Milton; Donald H. Blackburn, Brookville; Darryl W. Bernard, Dayton; Charles L. Logan, Fairfield, all of Ohio

[73] Assignee: Premark FEG Corporation, Wilmington, Del.

[21] Appl. No.: 230,853

[22] Filed: Apr. 21, 1994

[51] Int. Cl.[6] ..... B08B 15/00

[52] U.S. Cl. ..... 134/57 D; 134/58 D; 134/56 D; 134/200; 134/201; 16/308

[58] Field of Search ..... 134/200, 57 D, 134/56 D, 58 D, 201; 16/308; 312/228

[56] References Cited

U.S. PATENT DOCUMENTS

| | | | |
|---|---|---|---|
| 2,395,456 | 2/1946 | Bunker | 16/308 |
| 2,774,099 | 12/1956 | Thomas | 16/308 |
| 3,022,536 | 2/1962 | Floehr | 16/308 |
| 3,103,035 | 9/1963 | Magnuson | 16/308 |
| 3,115,685 | 12/1963 | Wheeler . | |
| 3,209,391 | 10/1965 | Mangini . | |
| 3,507,074 | 4/1970 | Gallegos . | |
| 3,787,923 | 1/1974 | Peterson | 16/308 |
| 4,348,786 | 9/1982 | Hirose | 16/308 X |
| 4,637,167 | 1/1987 | Svensson . | |
| 4,646,472 | 3/1987 | Sugawara . | |
| 4,681,307 | 7/1987 | Leonard | 16/308 X |
| 4,696,078 | 9/1987 | Stromquist . | |
| 4,823,437 | 4/1989 | Tatara . | |
| 4,905,347 | 3/1990 | Worth . | |
| 5,228,240 | 7/1993 | Barroero . | |

FOREIGN PATENT DOCUMENTS

| | | | |
|---|---|---|---|
| 590584 | 12/1924 | France . | |
| 2015953 | 1/1980 | France | 312/228 |
| 2457367 | 1/1981 | France . | |
| 2658233 | 8/1991 | France . | |
| 4132568 | 5/1992 | Germany | 16/308 |
| 1-280186 | 11/1989 | Japan | 16/308 |

*Primary Examiner*—Frankie L. Stinson
*Attorney, Agent, or Firm*—Thompson, Hine and Flory

[57] ABSTRACT

A torsion bar assembly for a dishwasher door having a stainless steel torsion bar enclosed in an elongated stainless steel tube such that the bar rotates within the tube as the door is moved between an open and a closed position. One end of the bar and tube are fixedly disposed in a rectangular boss which is fixedly attached to the dishwasher door; and a second end of the tube and bar are releasably disposed in a cylindrical boss which is welded to a door hinge. The bosses are attached on opposite sides of the interior door panel, so that the torsion bar extends substantially the width of the door. The torsion bar is protected from water by the corrosion-resistant tube, and by a pair of quad-rings which are disposed in recesses in the cylindrical boss. The quad-rings prevent water from seeping through the boss and reaching the torsion bar. When the ends of the torsion bar are disposed in the bosses, the bar is spaced within the tube to permit the bar to rotate independently of the tube. This rotation builds up torque in the torsion bar. This torque is released when the door is closed, to supplement the effort needed to close the door.

8 Claims, 1 Drawing Sheet

TORSION BAR ASSEMBLY

BACKGROUND OF THE INVENTION

The present invention relates to a torsion bar assembly, and more particularly, to a torsion bar assembly for an industrial dishwasher door which reduces the force necessary to close the door.

Appliances in the commercial cooking environment are often manufactured from heavy stainless steel in order to increase their durability. While using stainless steel has many advantages, it results in a heavy appliance that can be a burden to operate. Using stainless steel can particularly be a problem with an appliance, such as a dishwasher, which has a door that must be continuously opened and shut in order to operate the appliance. Lifting a heavy stainless steel door in order to close the dishwasher can cause worker strain, which over time can lead to worker injury and lost work time.

Efforts to reduce the force required to close these heavy dishwasher doors have been complicated by the wet environment inside a dishwasher. Without special treatment, door closing mechanisms would normally corrode from the continuous water contact, necessitating repeated replacement. Therefore, a need exists for a door closing mechanism that reduces the effort required to close a heavy dishwasher door, yet is corrosion-resistant and able to withstand the wet interior of a dishwasher.

SUMMARY OF THE INVENTION

It is an object of the present invention to provide a torsion bar assembly for a dishwasher door, which produces torque to assist in closing the door yet is not corroded by the water and detergent in the dishwasher. In the present invention, a torsion bar is mounted inside the dishwasher along the interior door panel. The torsion bar is enclosed in a corrosion-resistant stainless steel tube to prevent water from contacting and corroding the bar. The torsion bar and tube are anchored at one end to the door panel, and at a second end to a hinge which extends from the door frame. When the dishwasher door is opened, the torsion bar rotates inside the tube to create an internal torque in the bar. This torque is released as the bar unwinds and the door is moved back into a closed position. This unwinding of the bar facilitates the door closing.

Accordingly, the present invention provides a torsion bar assembly for a dishwasher door, having a stainless steel torsion bar enclosed in an elongated corrosion-resistant stainless steel tube, such that the bar rotates within the tube as the door is moved between an opened and a closed position. One end of the bar and tube are fixedly mounted in a rectangular boss which is welded to the dishwasher door; and the other end of the tube and bar are releasably disposed in a cylindrical boss which is welded to a door hinge. The bosses are attached on opposite sides of the interior door panel, such that the torsion bar extends substantially the width of the door along the axis of the door. The torsion bar is protected from the dishwasher moisture by the corrosion-resistant tube, and by a pair of quad-rings which are disposed between the tube and the cylindrical boss. The quad-rings prevent moisture from seeping through the cylindrical boss and reaching the torsion bar. The torsion bar is spaced within the tube such that the bar can rotate independently of the tube between the bosses. This rotation builds up torque in the torsion bar, which is released when the door is closed, to supplement the effort needed to close the door.

Other objects and advantages of the present invention will be apparent from the following description, the accompanying drawings and the appended claims.

DETAILED DESCRIPTION

Figure 1:
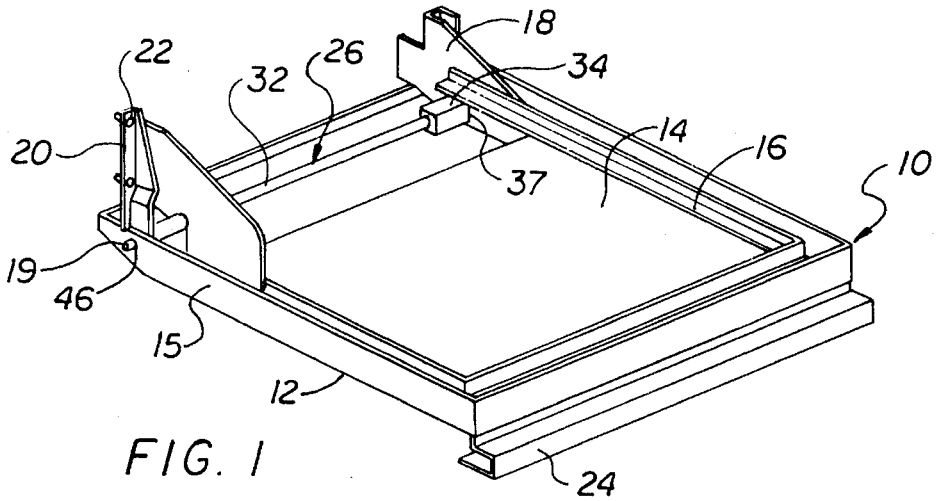
FIG. 1 is perspective view of a dishwasher door illustrating the torsion bar assembly of the present invention.

FIG. 1 shows a dishwasher door assembly 10 with the torsion bar assembly 26 of the present invention installed thereon. The door 10 includes an exterior panel 12, an interior panel 14 and sides 15. The interior panel 14 includes a peripheral support 16 extending along the top and side portions of the panel, to provide support for the door 10. A pair of conventional door hinges 18, 20 are attached to the bottom portion of the panel 14 between the support 16 and sides 15. Each of the hinges 18, 20 include a pivot pin 19 which carries the weight of the door as it is opened and closed. The pivot pin 19 rotates relative to an annular opening in the door frame (not shown) to move the door between an open and a closed position. Each of the hinges 18, 20 are connected to the door frame by a pair of screws 22. The door 10 further includes a handle 24 attached along the upper portion of the exterior door panel 12. The handle 24 enables the door 10 to be manually moved toward or away from the door frame. A torsion bar assembly 26 is disposed adjacent the lower edge of the interior door panel 14, and extends longitudinally along the axis of the door between the hinges 18, 20.

Figure 2:
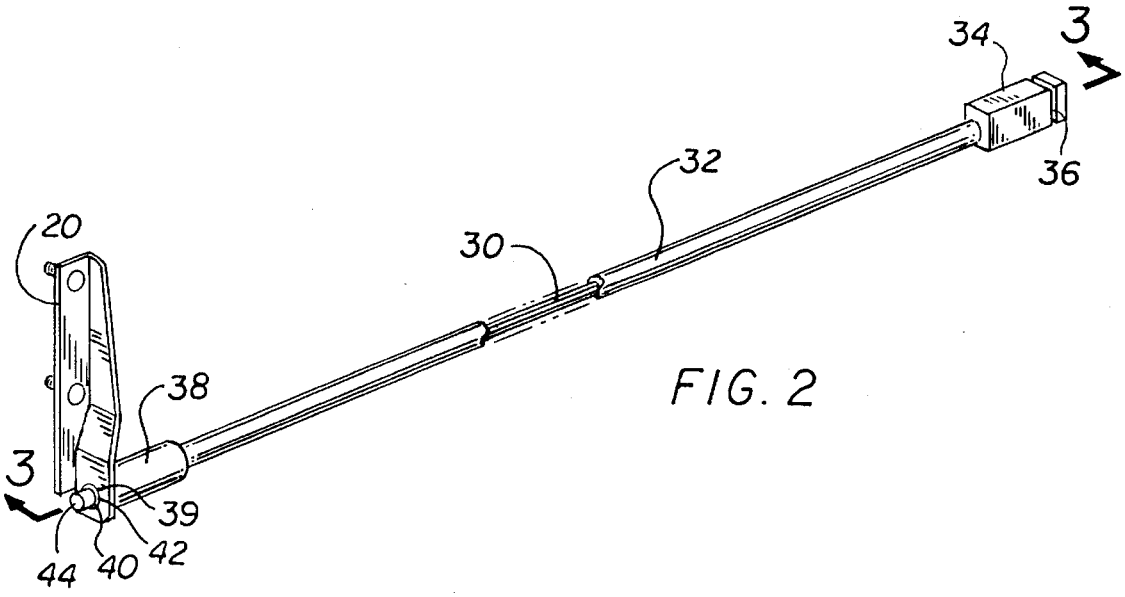
FIG. 2 is a perspective view of the torsion bar assembly, with the tube partially broken away to show the torsion bar.

As shown in FIG. 2, the torsion bar assembly 26 includes an elongated torsion bar 30. In the preferred embodiment, the torsion bar 30 is composed of 400 series heat-treated stainless steel and is of a hexagonal cross-sectional shape. Although in the preferred embodiment the bar is hexagonal, it is within the scope of the invention to have the bar be any other non-circular shape that enables it to lockingly engage the bosses on the torsion bar assembly as will be described below. Surrounding the torsion bar in telescoping relation is a tube 32. The tube 32 is preferably composed of 300 series corrosion-resistant stainless steel. The bar 30 is of a greater length than the tube 32 so that a portion of the bar extends beyond each end of the tube. The tube is slightly spaced from the edges of the bar 30 to permit the bar to rotate easily within the tube. The tube 32 protects the bar from the moisture and corrosive elements in the dishwasher, and also protects the other elements in the dishwasher in the event that the torsion bar breaks during operation.

A boss 34 having a generally rectangular shape is located at one end of the torsion bar assembly 26. The rectangular boss 34 is preferably composed of stainless steel. A groove 36 is located adjacent one end of the boss 34 and extends completely around the periphery of the boss 34. The groove 36 corresponds with a notch 37 formed in the support 16 to lock the boss 34 into position on the panel 14 when the assembly 26 is installed on the door 10.

A cylindrical boss 38 is located at the second end of the torsion bar assembly, and connects the assembly to the door hinge 20. The cylindrical boss 38 includes a cylindrical shoulder portion 39 located-at the outer end of the boss 38, which is of a smaller diameter than the remainder of the boss 38. The shoulder portion 39 extends through an aperture 42 in the door hinge 20 to connect the cylindrical boss 38 to the hinge 20. The cylindrical boss 38 is welded or otherwise suitably secured to the hinge 20 adjacent to the aperture 42 and shoulder portion 39. A bore extends through the center of the shoulder portion 39, and the pivot pin 19 is disposed in the bore on the side of the hinge 20 opposite the cylindrical boss 38. The pivot pin 19 passes through an aperture 46 in the door 10 and is disposed in an aperture in the door frame in order to pivot the door 10.

Figure 3:
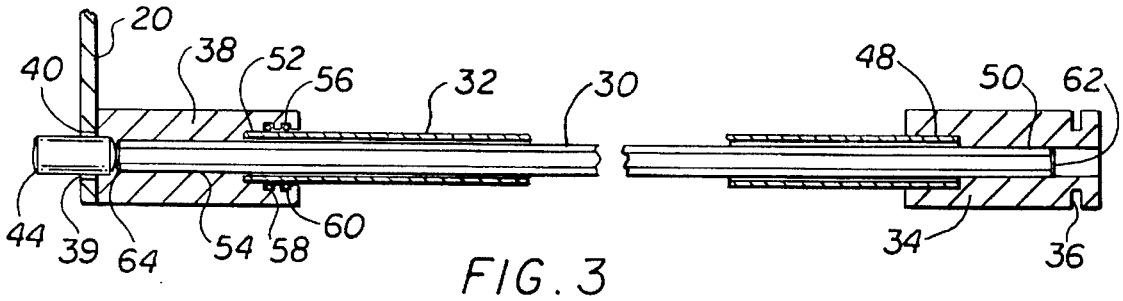
FIG. 3 is a cross-sectional view of the torsion bar assembly taken along line A—A of FIG. 2.

As shown in FIG. 3, the rectangular boss 34 includes a bore 47 extending through the middle of the boss. The bore 47 includes a large diameter portion 48, and a narrow diameter portion 50. The bore portion 48 is located in the inner half of the rectangular boss 34 and has a circular cross-section substantially equal in diameter to the tube 32 such that the tube 32 fits tightly within the bore 48. The bore portion 50 extends from the bore portion 48 to the outer edge of the rectangular boss 34. In the preferred embodiment, the bore portion 50 is of a hexagonal cross-section substantially equal in shape and size to the cross-section of the torsion bar 30 so that the bore lockingly engages the bar within the boss 34. It is to be understood that the bore portion 50 can have a cross-section of a different, non-circular cross-section then hexagonal provided that the bore is of the same cross-sectional shape as the bar, so that the bar is locked in the bore and does not rotate within the rectangular boss 34 as the door pivots. The tube 32 is engaged within and extends substantially the length of the bore portion 48. The bar 30 extends beyond the end of the tube 32 and the second bore portion 50 such that the bar is lockingly engaged in the second bore portion 50. The tube 32 and bar 30 are secured within the bore 47 by an adhesive material.

The cylindrical boss 38 includes a bore 51 extending through the center of the boss. The bore 51 includes a large diameter portion 52, and a smaller diameter portion 54. The cylindrical boss bore portions 52, 54 engage the second end of the bar 30 and tube 32. The bore portion 52 is located in the inner portion of the boss 38, and is of a diameter substantially equal to the diameter of the tube 32, for tightly engaging the tube 32 therein. The bore portion 54 extends between the bore portion 52 and the hinge 20. In the preferred embodiment, the second bore 54 has a hexagonal cross-section that is substantially equal in size and shape to the cross-section of the bar 30, such that the bore 54 lockingly engages the bar 30 within the cylindrical boss. However, it is to be understood that the bore portion 54 can be any non-circular shape that corresponds with the bar 30 and rectangular boss bore portion 50 provided that the bar is locked in place in the bore, and does not rotate within the cylindrical boss as the door pivots. A pair of quad-rings 56 of a conventional type are located in the cylindrical boss 38 adjacent to the inner edge of the boss. The quad-rings 56 are disposed within recesses 58, 60 formed in the bore portion 52 and extend from the recesses 58, 60 to the tube 32 to provide a water-tight seal around the tube 32.

In an alternate embodiment, the stainless steel tube 32 is replaced with a plastic tube which extends along the interior door panel 14 and which is disposed in the rectangular and cylindrical bosses 34, 38 in the same manner as the stainless steel tube described above.

As shown in FIG. 1, when assembled on a dishwasher door, the rectangular boss 34 is fixedly attached to the door panel 14 along the axis of the door, and adjacent the support 16. The groove 36 in the boss 34 engages the notch 37 in the support 16 to lock the boss 34 in place on the door panel 14. The first end of the tube 32 and the bar 30 are disposed in the bore 47 in the boss 34, with the bar 30 extending beyond the end of the tube 32 and the bore portion 48, into the hexagonal bore portion 50. The second end of the tube 32 and bar 30 are inserted into the cylindrical boss 38 on the side of the door panel 14 opposite the rectangular boss 34. The second end of the bar 30 extends beyond the end of the tube 32 and the bore portion 52, into the hexagonal bore portion 54. The bar 32 is assembled in the bosses 34, 38 such that a first end 62 of the bar is fixedly attached to the door 10 to move with the door, and a second end 64 of the bar is fixedly attached to the door frame to remain stationary with the frame. During assembly between the bosses 34, 38, the torsion bar 30 is preferably preloaded about 30 degrees to impart an initial torque to the torsion bar.

In operation, when the door 10 is pivoted into a lowered, open position, the first end of the bar 62 rotates with the rectangular boss 34 and door 10 through a 90 degree arc, while the second end 64 remains anchored to the door frame by means of boss 38. With both ends retained by the bosses 34 and 38, the bar 30 rotates 90° in response to the opening of the door 10. Combined with the preload of 30°, the bar is rotated a total of 120° in the open door position. This rotation builds up energy which is stored in the bar while the door is open. When the handle is lifted to close the door, the bar unwinds. As the bar unwinds, the energy is released from the bar and imparts an upward force along the pivot axis of the door to enable the door to be easily closed.

While the assembly described constitutes a preferred embodiment of the invention, it is to be understood that the present invention is not limited to this precise form, and that variations may be made without departing from the scope of the invention.

What is claimed is:

1. A dishwasher door having a torsion bar assembly comprising:

an elongated stainless steel corrosion-resistant tube having a first end and a second end;

a stainless steel corrosion-resistant torsion bar disposed in said tube, said bar having first and second ends that extend beyond said tube, and said bar having a hexagonal cross-section;

a rectangular boss for attaching said first ends of said tube and said bar to said door, said first ends of said tube and said bar being disposed in a bore in said boss, said bore including a first and a second portion, said first portion having a hexagonal cross-section for engaging said bar and said second portion having a cylindrical cross-section for engaging said tube; and a cylindrical boss for connecting said second end of said tube and said bar to a frame surrounding said door, said second ends of said bar and said tube being disposed in a bore in said cylindrical boss, such that said bar rotates between said door and said frame as said door is opened, to create a force in said bar which is released as said door is closed to facilitate said closing;

said cylindrical boss including means for sealing said bore between said tube and said boss.

2. The assembly of claim 1 wherein said cylindrical boss bore includes a first portion and a second portion, said first portion having a hexagonal cross-section for engaging said bar, and said second portion having a cylindrical cross-section for engaging said tube.

3. The assembly of claim 2 wherein said rectangular boss includes a groove for positioning said rectangular boss on said door.

4. The assembly of claim 3 wherein said bar is preloaded 30 degrees.

5. A dishwasher door having a torsion bar assembly comprising:

an elongated corrosion-resistant stainless steel tube having a first end and a second end;

a stainless steel torsion bar enclosed in said tube, said bar having first and second ends that extend beyond said tube;

a rectangular boss fixedly attached to a panel on said door adjacent an edge of said door, said rectangular boss having a bore disposed therein, said first end of said bar and said first end of said tube being fixedly disposed in said bore;

a cylindrical boss welded to one of said door hinges, said hinge being located on a side of said door opposite said rectangular boss, said cylindrical boss including a bore in which said second end of said bar and said second end of said tube are disposed; and sealing means disposed in said cylindrical boss bore for providing a seal between said tube and said boss, said bar rotating in said tube between said cylindrical boss and said rectangular boss when said door is opened, to produce and store a torque force in said bar which is released when said door is closed, to facilitate said closing.

6. A dishwasher door having a torsion bar assembly comprising:

an elongated corrosion-resistant stainless steel tube having a first end and a second end;

a stainless steel torsion bar enclosed in said tube, said bar having first and second ends that extend beyond said tube;

a rectangular boss fixedly attached to a panel on said door adjacent an edge of said door, said rectangular boss including a bore disposed therein, said bore having a first portion and a second portion, said first end of said tube being disposed in said first bore portion and said first end of said bar being fixedly disposed in said second bore portion;

a cylindrical boss welded to one of said door hinges, said hinge being located on an opposite side of said door from said rectangular boss, said cylindrical boss including a bore disposed therein, said bore having a first portion and a second portion, said second end of said tube being disposed in said first bore portion and said second end of said bar being disposed in said second bore portion; and sealing means disposed in said first cylindrical boss bore portion for providing a seal between said tube and said cylindrical boss, said bar rotating in said tube between said bosses when said-door is opened, to produce and store a torque force in said bar which is released when said door is closed, to facilitate said closing.

7. The door of claim 6 wherein said tube is plastic.

8. A dishwasher having a base, a tank supported by the base, a washer assembly and pump disposed in the tank, controls for operating the washer assembly and pump, and a door connected to the tank by a pair of hinges, wherein the improvement comprises: a torsion bar assembly including, an elongated corrosion-resistant stainless steel tube having a first end and a second end;

a stainless steel torsion bar enclosed in said tube, said bar having first and second ends that extend beyond said tube;

a rectangular boss fixedly attached to a panel on said door adjacent an edge of said door, said rectangular boss including a bore disposed therein, said bore having a first portion and a second portion, said first end of said tube being disposed in said first bore portion and said first end of said bar being fixedly disposed in said second bore portion;

a cylindrical boss welded to one of said door hinges, said hinge being located on an opposite side of said door from said rectangular boss, said cylindrical boss including a bore disposed therein, said bore having a first portion and a second portion, said second end of said tube being disposed in said first bore portion and said second end of said bar being disposed in said second bore portion; and sealing means disposed in said first cylindrical boss bore portion for providing a seal between said tube and said cylindrical boss, said bar rotating in said tube between said bosses when said door is opened, to produce and store a torque force in said bar which is released when said door is closed, to facilitate said closing.

* * * * *